US006362788B1

(12) United States Patent
Louzir

(10) Patent No.: US 6,362,788 B1
(45) Date of Patent: Mar. 26, 2002

(54) ELECTROMAGNETIC WAVE TRANSMITTER/RECEIVER

(75) Inventor: Ali Louzir, Rennes (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/582,395

(22) PCT Filed: Dec. 30, 1998

(86) PCT No.: PCT/FR98/02922

§ 371 Date: Jun. 23, 2000

§ 102(e) Date: Jun. 23, 2000

(87) PCT Pub. No.: WO99/35711

PCT Pub. Date: Jul. 15, 1999

(30) Foreign Application Priority Data

Dec. 31, 1997 (FR) ..... 97 16767

(51) Int. Cl.[7] ..... H01Q 1/38

(52) U.S. Cl. ..... 343/700 MS; 343/725; 343/781 R; 343/786

(58) Field of Search ..... 343/700 MS, 840, 343/772, 895, 773, 786, 781 R, 725

(56) References Cited

U.S. PATENT DOCUMENTS 4,825,221 A 4/1989 Suzuki et al.
5,041,840 A 8/1991 Cipola et al.

FOREIGN PATENT DOCUMENTS

DE 2603055 8/1977 ..... H01Q/19/10

OTHER PUBLICATIONS

Patent Abstracts of Japan, vol. 009, No. 131.

Zurcher JF and Gardiol FE: "Broadband Patch Antennas" 1995, Artech House, Boston, USA.

Kraus JD: "Antennas" 1950, McGraw–Hill, New York.

European Search Report dated Jun. 7, 1999.

*Primary Examiner*—Don Wong
*Assistant Examiner*—Hoang Nguyen
(74) *Attorney, Agent, or Firm*—Joseph S. Tripoli; Kuniyuki Akiyama

(57) ABSTRACT

The invention concerns an electromagnetic wave transmitter/receiver device, comprising a body (18), characterised in that it comprises in combination: a receiver plate (16) incorporated in the body (18) including a first array of n radiating elements ($30_1$, $30_2$, $30_3$, $30_4$) with a microstrip structure for receiving electromagnetic waves; means for transmitting (19, 20, 22, 23, 24) electromagnetic waves with longitudinal radiation defining a radiation axis for transmitting electromagnetic waves, said means including excitation means (24) for exciting the longitudinal radiation means (19, 20, 22, 23); said radiation means being substantially of constant cross-section in the body (18), perpendicularly intersecting the receiver plate (16) in a circular aperture around which are symmetrically arranged said radiating elements ($30_1$, $30_2$, $30_3$, $30_4$), said receiving and transmitting means being arranged such that their respective phase centres are substantially arranged in a so-called focusing zone. The invention is particularly applicable to the field of microwave frequency transmission exchanged between a station and a residence or between a satellite and a residence, in the context of satellite telecommunication.

14 Claims, 5 Drawing Sheets

ELECTROMAGNETIC WAVE TRANSMITTER/RECEIVER

Figure 1:
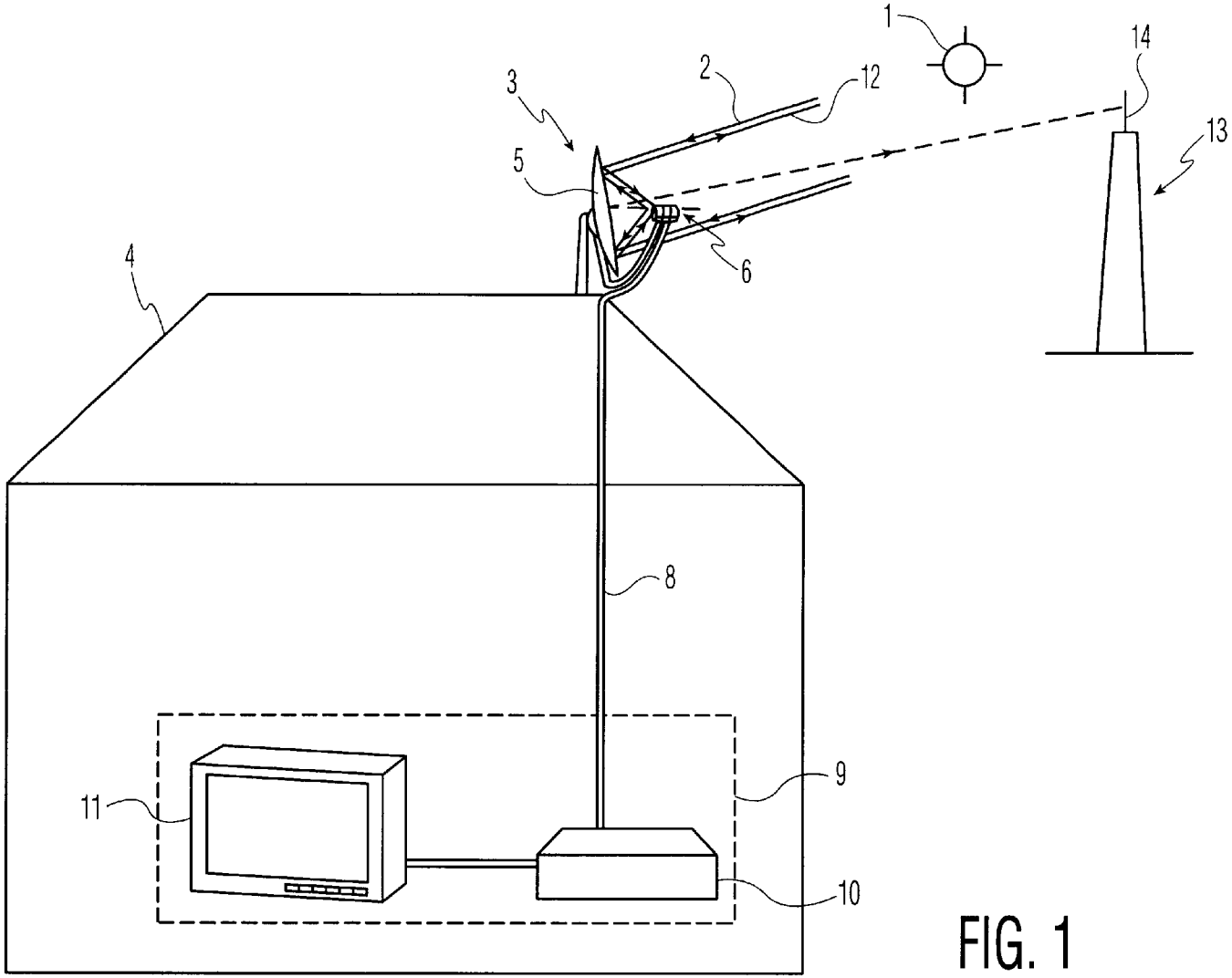

The invention relates to a device for the reception/transmission of electromagnetic waves.

Interactive cordless telecommunication services are developing rapidly. These services relate to telephones, faxes, television, especially digital television, the field called "multimedia" and the internet array. The equipment for these major broadcasting services must be available at a reasonable cost. The same applies, in particular to the receiver/transmitter of the user who has to communicate with a server, most often via a telecommunications satellite. Generally these communications are carried out in the ultrahigh frequency range. For example the C band is used, from 3.7 GHz to 4.2 GHz (3.4 GHz to 4.2 GHz in the extended C band) for reception and from 6.4 GHz to 6.7 GHz for transmission.

In these frequency ranges, it is usually possible to use a waveguide receiver and a waveguide transmitter, the two waveguides being separate.

Implementation of this technology is expensive if a return link from the user to the base station has to be ensured for the purpose of routing information flow or user commands to the source of the service (for example, in the field of audiovisual programming or pay per view). It is therefore costly. Furthermore, its weight and size are incompatible with use by individuals.

Document U.S. Pat. No. 5,041,840 (Cipolla et al.) describes a device having two coaxial waveguides exciting a horn whose radiating aperture is coplanar with an array of radiating patches. The array has the same phase centre as the horn. Thus the transmission and reception directions of the device may be coincident.

However, the unit comprising the array and the radiating aperture takes up too large an area in the array plane. The size problem is not solved.

The invention remedies the aforementioned drawback.

To this end, the subject of the invention is an electromagnetic wave reception/transmission device, comprising a body, characterized in that it combines:

- a reception circuit board incorporated in the body, comprising a first array of n radiating elements with a microstrip structure for receiving electromagnetic waves in a first frequency band,
- electromagnetic wave transmission means with longitudinal radiation defining a radiation axis for the transmission of electromagnetic waves in a second frequency band, the said means comprising excitation means for exciting longitudinal radiation means,
- the said transmission means being of nearly constant cross section in the body, perpendicularly intersecting the reception circuit board in a circular aperture around which the said radiating elements are symmetrically arranged,
- the said reception and transmission means being laid out so that their respective phase centres lie approximately in a so-called focusing region.

Such a hybrid device (that is to say with waveguide technology and microstrip technology) is feasible at reasonable cost. Its, size and weight are reduced. Excellent isolation between the transmission and reception signals is obtained. Furthermore, use of longitudinal radiation means has the advantage of a broad frequency band for transmission. Above all it should be noted that the use of such a longitudinal radiation means of constant cross section allows the area occupied by these means in the reception circuit board plane to be limited compared with a horn, which makes reception and transmission in close frequency bands possible and which also enables radiating elements to be moved closer together, therefore reducing the number n of radiating elements. Typically the device according to the invention enables a ratio between the central frequencies of the respective transmission and reception bands of less than or equal to three to be obtained, as will be shown at the end of the present application.

According to one embodiment, the said focusing region is reduced to a point forming the phase centre of the said device.

Advantageously, the said radiation means comprise a dielectric rod with longitudinal radiation whose axis is coincident with the transmission radiation axis.

According to one embodiment, the said excitation means comprise a waveguide.

According to one embodiment, the said radiation means comprise a helical device having a series of turns.

In this case, the said excitation means can be pictured as a coaxial line.

According to one embodiment, n is equal to 4.

According to one embodiment, the said dielectric rod has the shape of a cylinder with conical ends.

According to one embodiment, the said excitation means are coupled to a microstrip transmission circuit board laid out in a straight section of the excitation means in the body for transmission of electromagnetic waves.

According to one embodiment, the device according to the invention has a pair of probes arranged on the transmission circuit board and at right angles to each other and capable of transmitting orthogonally polarized waves.

According to one embodiment, the microstrip transmission circuit board has a frequency conversion circuit.

According to one embodiment, the microstrip reception circuit board has a frequency conversion circuit.

According to one embodiment, the device, according to the invention has an intermediate circuit board having at least part of the frequency conversion circuit associated with the reception circuit board and/or the transmission circuit board.

According to one embodiment, an auxiliary circuit board is associated in a parallel manner with the reception circuit board and has a second array comprising a plurality of radiating elements opposite the respective radiating elements of the first array and of resonant frequency close to the resonant frequency of the first array so that the pair of arrays of radiating elements opposite each other is equivalent to a single array with an extended bandwidth.

According to one embodiment, the waveguide is closed by a quarter-wave ($\lambda_{GT}/4$) cavity of length equal to a quarter of the wavelength ($\lambda_{GT}$) of the guided wave transmitted.

The subject of the invention is also an electromagnetic wave reception/transmission system having a means for focusing waves, characterized in that it is fitted with a device according to the invention.

Advantageously, the said focusing means have a reflector, which is preferably parabolic, and the device is laid out in such a way that the said focusing region nearly coincides with the focus of the said reflector, the said device thus operating as the primary source of the system.

An additional advantage is that the said focusing means have an electromagnetic lens and that the said device is laid out in such a way that the said focusing region nearly coincides with the focus of the said electromagnetic lens, the said device thus operating as the primary source of the system.

Figure 2:
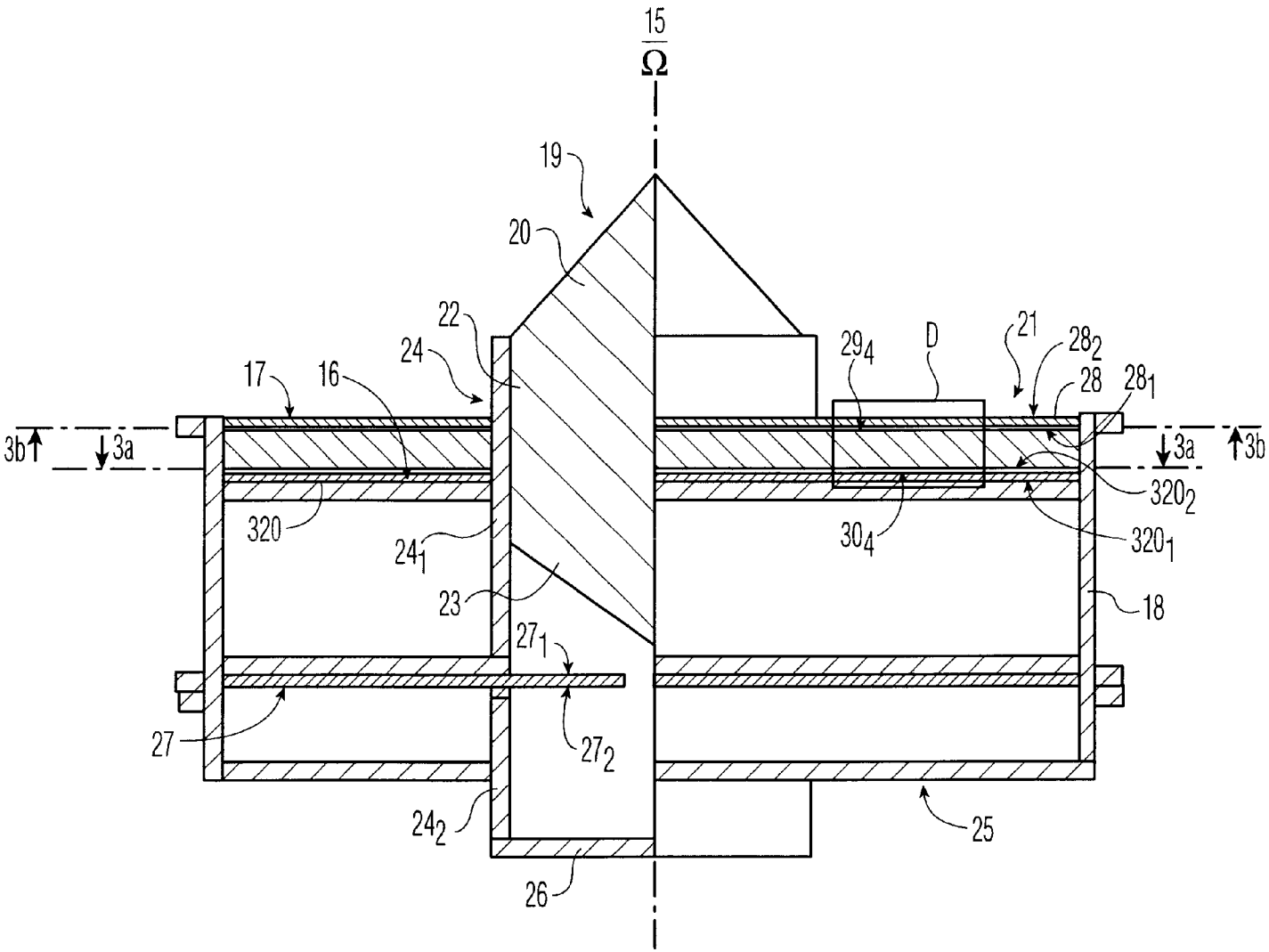
Figure 3A:
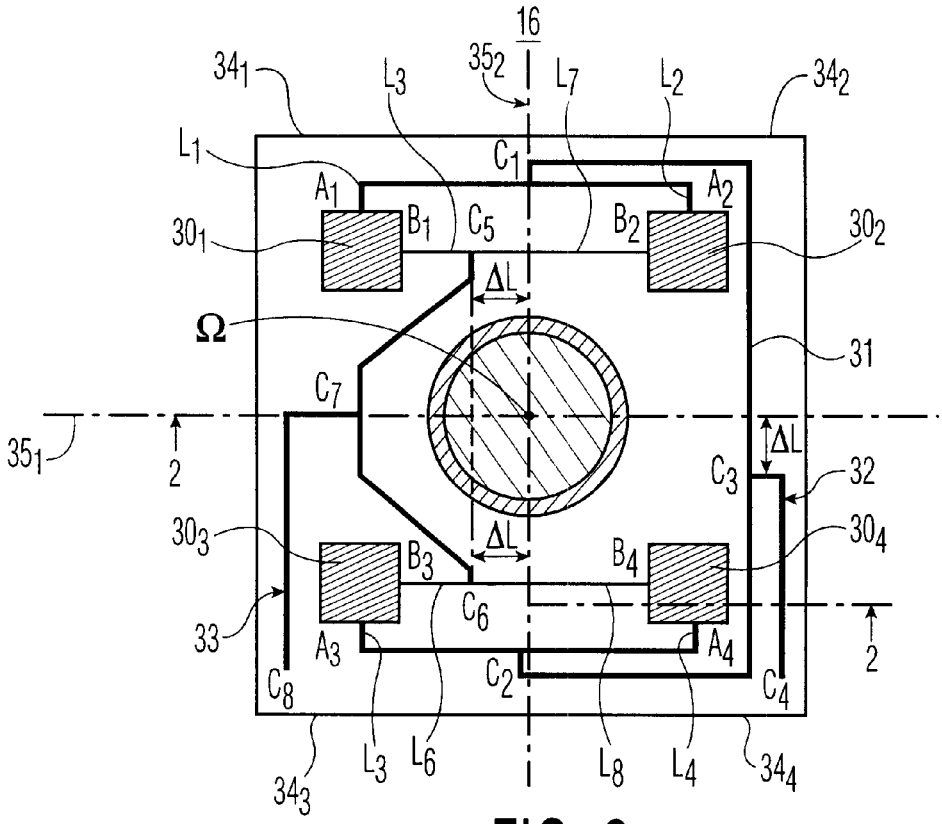
Figure 3B:
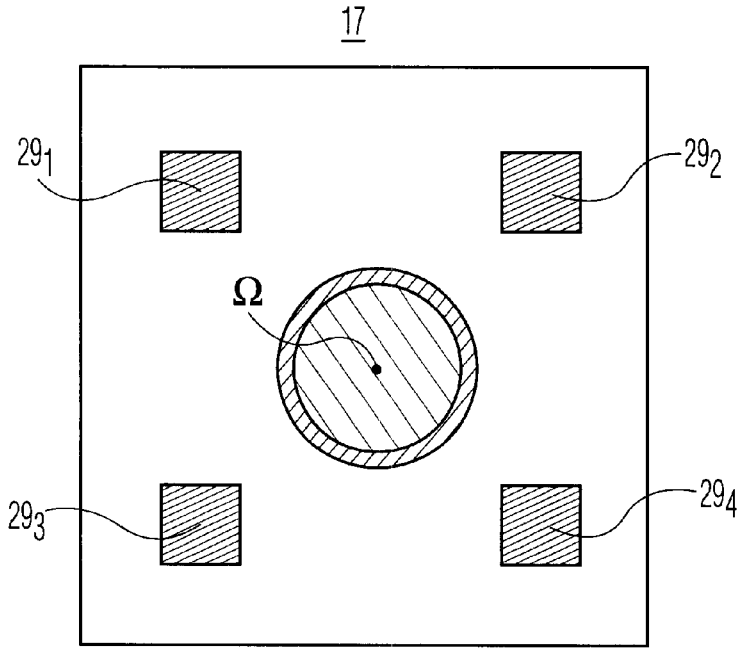
Figure 3C:
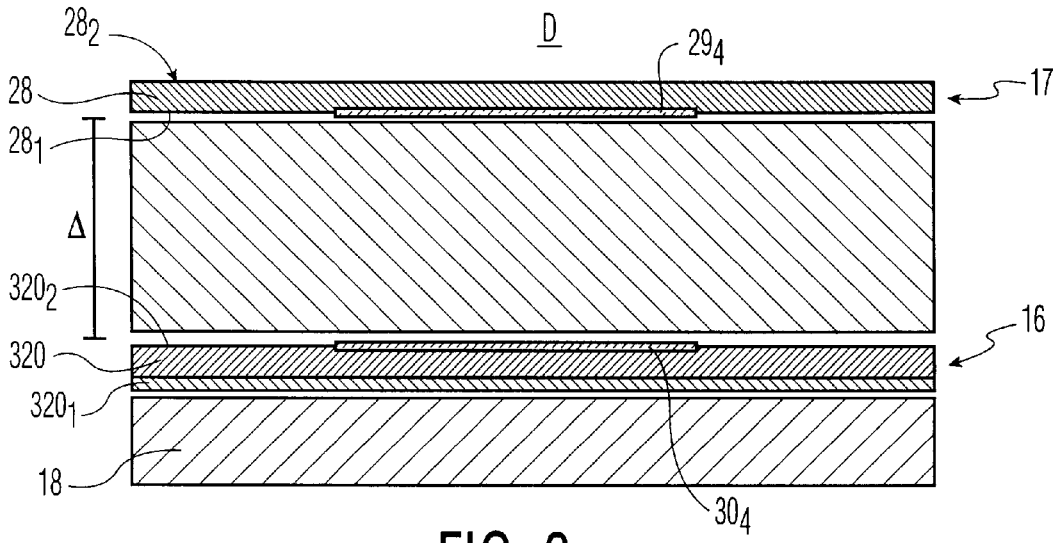
Figure 4:
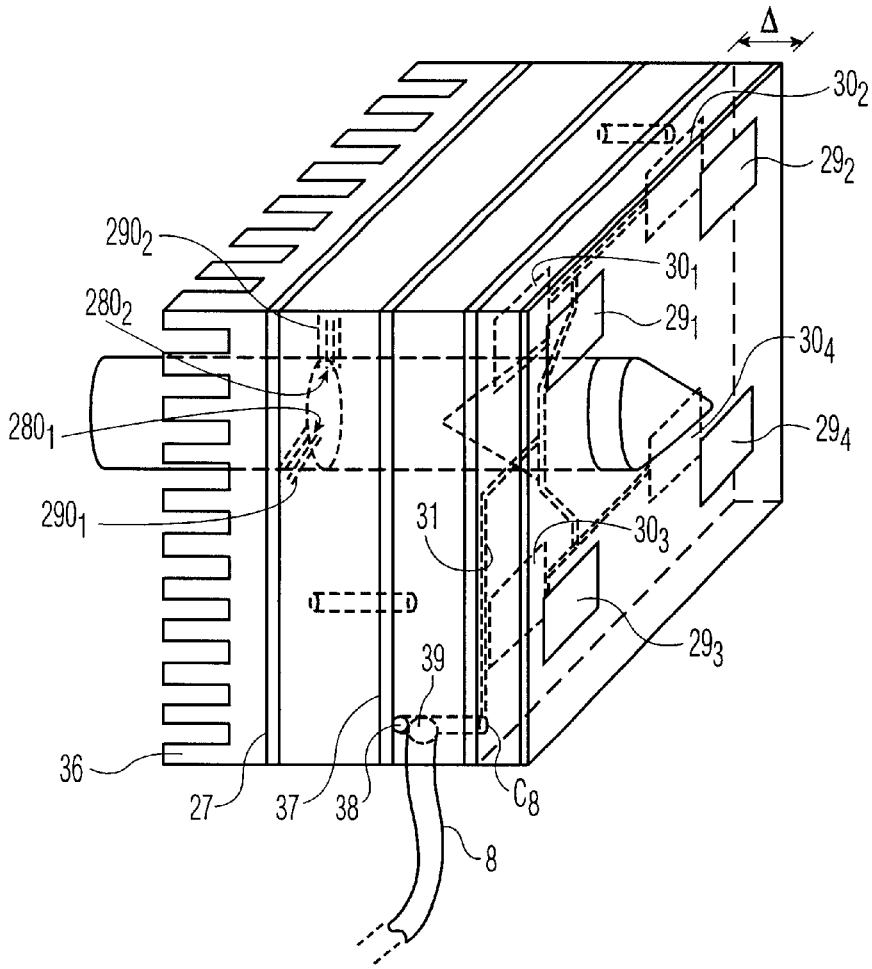
Figure 5:
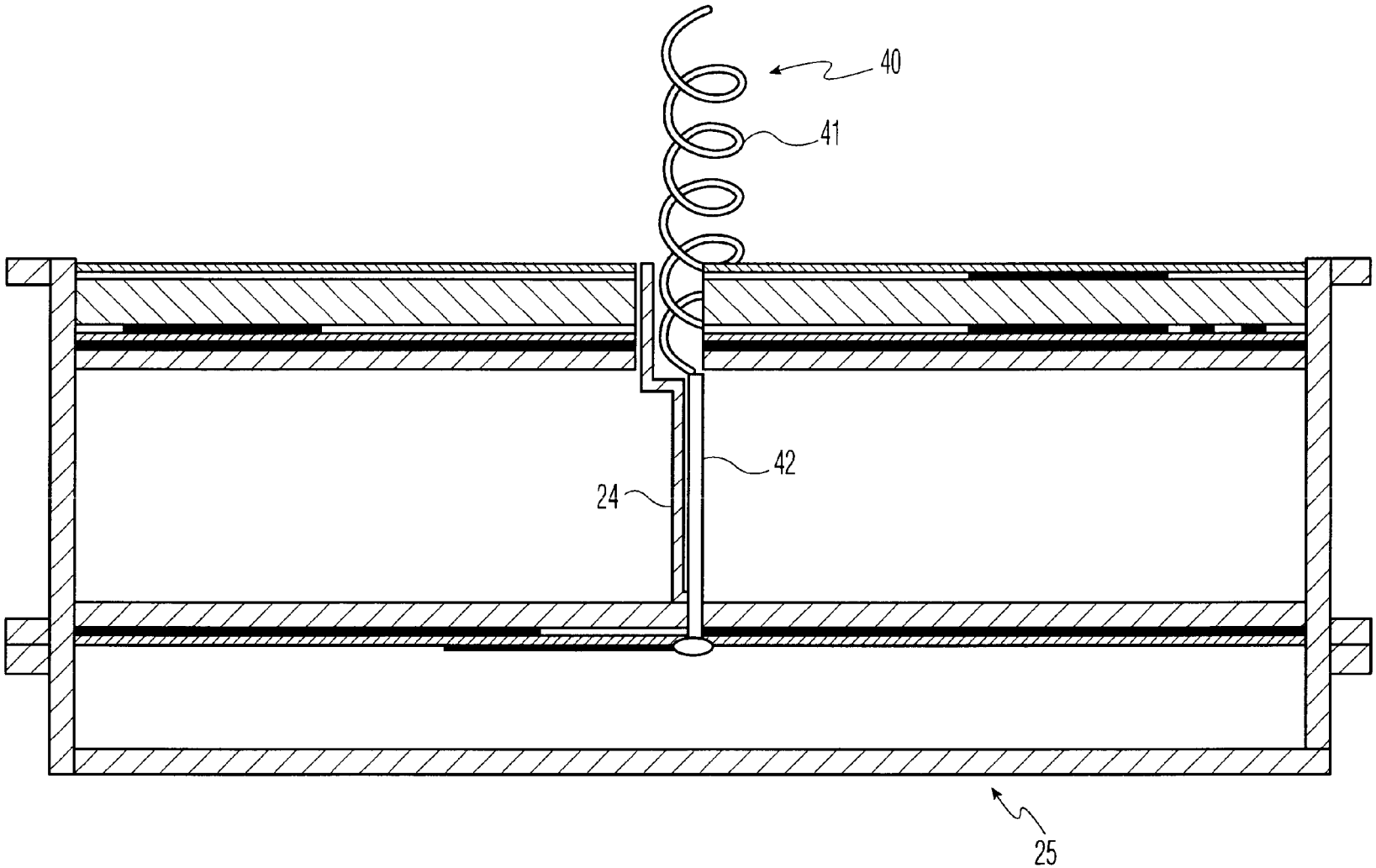

Other characteristics and advantages of the present invention will emerge from the description of the embodiments hereinafter, taken by way of non-limiting examples, with reference to the appended figures in which:

FIG. 1 shows the basic design of the user channel uplink or the downlink channel used by one embodiment of a satellite reception/transmission system according to the invention, FIG. 2 shows a vertical section through the line A—A of FIG. 3.*a* of one embodiment of a device according to the invention, FIG. 3.*a* shows a top view through line B—B of FIG. 2 of one embodiment of the reception circuit board according to the invention while FIG. 3.*b* shows a bottom view through the line C—C of FIG. 2 of one embodiment of the auxiliary circuit board according to the invention and FIG. 3.*c* shows an enlarged view of a region D of FIG. 2, FIG. 4 shows a perspective view of a variant of the invention, FIG. 5 shows a variant of the embodiment of FIG. 2.

To simplify the description, the same references will be used in the different figures to designate elements fulfilling identical functions. It is worth noting that, in the present application, the complete unit (guide, dielectric) could more simply be called a guide.

FIG. 1 shows the basic design of the downlink channel used by a satellite reception/transmission system according to the invention.

Generally, information distributed by the reception/transmission system according to the invention may in particular originate from satellites, from recording studios, from hardwired networks, or may be exchanged within the framework of an MMDS (Multipoint Multichannel Distribution System), LMDS (Local Multipoint Distribution System) or MVDS (Multipoint Video Distribution System) system well known to those skilled in the art. In the present embodiment illustrated in FIG. 1, the envisaged framework is that of a bidirectional satellite-user-satellite link. In this application, a satellite 1 sends information items and programmes 2 available to users. These information items and programmes 2 are picked up by each user via the reception/transmission system having a small-diameter antenna 3 placed on the roof of a house 4 for example. The antenna 3 has a reflector 5 designed to focus the received energy onto its focus close to which a primary source 6 is housed, which source picks up and radiates the energy thus exchanged, having a frequency conversion device which is not shown for reasons of clarity. This converter converts the signals received by the satellite into intermediate frequencies and transmits them, via link means, for example a coaxial cable 8, to an interior unit 9 placed inside a house 4, comprising a decoder/coder 10 linked to means for using the transmitted information, for example a television receiver 11. Of course, for a multistorey building, this antenna 3, because of its small size, can be placed near the balcony of one storey. Furthermore, in this variant, a reception/transmitting antenna can be located at the top of the multistorey building and can be fitted with a first converter for conversion to higher frequencies (frequency bands close to 40 GHz) for cordless distribution of the signals to the various storeys. The antenna 3 then plays the role of collecting the signals thus distributed and a second frequency converter has the function of converting them to intermediate frequencies.

In the invention, the said antenna 3 is also used for the downlink 12 or the uplink 12. Thus the user, by means of a remote control for example, can reply to an interactive service. Information items are coded then transmitted, by means of the cable 8, to the high-frequency converter which converts the said information items into a higher transmission frequency band. The "user" uplink 12 transmits return data to the satellite 1 which therefore plays the role, among others, of collector and centralizer of the data transmitted by users for retransmission with a view to subsequent processing. The embodiment thus described therefore demonstrates a reception/transmission system in which the primary source 6 points in the same direction for transmission and reception. Furthermore, in a variant of this embodiment of the invention, if information items are sent by an earth station 13 (for example an MMDS station) by means of a transmitter/receiver 14, the return data is transmitted to the transmitter/receiver. Thus, in these two embodiments, the reception/transmission system according to the invention has to comprise a primary source 6 whose receiving antenna and transmitting antenna are such that their respective radiation patterns are maximized in one and the same direction.

According to another variant of the invention, the information items 2 could for example come from the satellite 1 and the return data could be transmitted to the MMDS earth station 13. This downlink is shown in dotted lines on FIG. 2. At present, the system according to the invention has to comprise one receiving antenna and one transmitting antenna pointing in two different directions, which means that at least one of the two antennas has to be out of focus.

It is possible to use the C band, given the considerable signal attenuation caused by rain in the Ku band in equatorial regions. At present, the uplink 12 operates in the 6.4 GHz to 6.7 GHz frequency band, while the downlink 2, denoting the channel for receiving, via the antenna 3 the information transmitted by the satellite 1, operates in the 3.7 GHz to 4.2 GHz frequency band. So that new services can be supported, the extended band C whose downlink 2 operates at the 3.4 GHz to 4.2 GHz frequency band, can also be used.

Data transmitted on the uplink 12 can be data relating to pay television, or more generally interactive television which provides the user with access to films, interactive games, telepurchasing and the downloading of software but also to services such as database consultation, reservations, etc.

FIG. 2 shows a vertical section through the line A—A of FIG. 3.*a* of one embodiment of a device 15 according to the invention in which a reception circuit board 16, a transmission circuit board 27 and an auxiliary circuit board 17 are provided. FIG. 3.*a* shows a top view through the line B—B of FIG. 2 of an embodiment of the reception circuit board 16 according to the invention while FIG. 3.*b* shows a bottom view through the line C—C of FIG. 2 of an embodiment of the auxiliary circuit board 17, FIG. 3.*c* showing an enlarged view of a region D of FIG. 2 which reveals the detailed structure of the various components of the reception circuit board 16 and of the auxiliary circuit board 17. FIG. 4 shows a perspective view of a variant of the embodiment of the invention described in FIGS. 2 and 3.*a* to 3.*c*.

According to the embodiment illustrated in FIGS. 2 and 3.*a* to 3.*c*, the device 15 has a parallelepipedal support or body 18 made of a conducting material, and a rod 19. The rod 19 has a cone 20 coming out of the top face 21 of the said body 18, whose circular base is centred on the intersection of the diagonals of the said top rectangular face 21 and whose vertex points out into space into which waves are radiated or from which waves are picked up. The base of this cone 20 is extended into a cylinder 22 and terminates in a cone 23 whose vertex points in the opposite direction to that of the cone 20. The rod 19 formed by the cone 20, the cylinder 22 and the cone 23 is made for example of compressed polystyrene, forming a longitudinal radiation dielectric antenna, namely one having a relatively narrow, rodlike, radiation pattern. The shape of this rod 19 explains to its name of cylindro-conical antenna. The rod 19 functions as a waveguide and transmits in a mode such that the radiation maximum appears along the direction of the rod 19. According to a variant (not shown), the rod 19 is hollow. The technology of such dielectric antennas is explained for example in the book "Techniques de l'ingénieur—Traité Electronique [Techniques for the Engineer—Electronic Treatise]", E3 283—p.11, version 3-1991.

The rod 19 is surrounded, below the base of the cone 20 in the direction of wave reception, by a cylindrical shell 24 whose axis D is coincident with axis of the rod 19. This shell 24 has, in the example, an external diameter of 3.66 cm and an internal diameter of 3.25 cm. The shell 24 extends inside the body 18 perpendicular to the cross sections of the latter and ends in a part which emerges from the lower face 25 of the body 18. This shell 24, which is made of conducting material, forms a waveguide whose walls are in contact with the body 18. The end part of the shell 24 emerging from the upper face 21 is open while that emerging from the lower face 25 of the shell 24 is closed by a metal plate 26. The shell 24 with its bottom 26 forms a resonant cavity.

The shell 24 is split perpendicularly into two parts $\mathbf{24}_1$ and $\mathbf{24}_2$ between which the transmission circuit board 27 of the electromagnetic wave transmission microstrip circuit is placed, into a straight section of the shell 24. Hereinafter the combination formed by the shell 24 and the rod 19 will be called a guide.

The circuit board 27, which forms a substrate, is made from a material of given dielectric permitivity, for example Teflon glass. It has an upper surface $\mathbf{27}_1$, turned towards the rod 19 and a lower surface $\mathbf{27}_2$ located on the other face of the substrate. The lower surface $\mathbf{27}_2$ is metallized, forming an earth plane, and is in contact with the conducting walls of the shell 24. The circuit board 27 is fed by two coplanar probes $\mathbf{280}_1$, and $\mathbf{280}_2$ which etched into the upper surface $\mathbf{27}_1$, and which penetrate inside the shell 24 through apertures without touching the wall of the shell 24. To enable the transmission of orthogonally polarized waves, the two probes $\mathbf{280}_1$, and $\mathbf{280}_2$ are arranged at right angles to each other. These two probes $\mathbf{280}_1$ and $\mathbf{280}_2$ are connected to the plate 27 by microstrip lines $\mathbf{290}_1$, $\mathbf{290}_2$, the technology of which is known, to a transmission circuit (not shown on the figures). This transmission circuit, which in the present embodiment is arranged on the circuit board 27, comprises a power amplifier and a frequency converter connected to the interior unit 9 via the coaxial cable 8.

According to one variant of the invention shown in perspective in FIG. 4, the device also has a radiator 36 located behind the transmission circuit board 27 of the microstrip transmission circuit, the said radiator being designed to dissipate the heat released by a power amplifier (not shown) laid out in the transmission circuit on the board 27. For the remainder of the description, elements fulfilling identical functions within the scope of the invention will only be shown on one of FIGS. 2, 3.*a* to 3.*c* and 4.

The part $\mathbf{24}_2$ closing the shell 24 is a section of quarter-wave waveguide of length $\lambda_{GT}/4$ (length of the guided wave) forming a resonant cavity and functioning as an open circuit in the plane of the circuit board 27 for transmitted: waves, $\lambda_{GT}$ being the wavelength of the-guided wave transmitted.

The upper face 21 has a substrate 28 followed successively in the wave reception direction, by an array of radiating elements $\mathbf{29}_1$, $\mathbf{29}_2$, $\mathbf{29}_3$, $\mathbf{29}_4$ for receiving electromagnetic waves, then by a space filled with foam to a thickness of between, for example, 4 mm to 7 mm, then an array of radiating elements $\mathbf{30}_1$, $\mathbf{30}_2$, $\mathbf{30}_3$, $\mathbf{30}_4$ for receiving electromagnetic waves, the array being associated with a microstrip excitation circuit 31, these being etched in a substrate 320. In the present embodiment, the radiating elements of the substrate 28 are formed by four square flat patches $\mathbf{29}_1$, $\mathbf{29}_2$, $\mathbf{29}_3$, $\mathbf{29}_4$, etched in the lower face $\mathbf{28}_1$, of the substrate 28 turned towards the inside of the body 18 and arranged uniformly around the centre of the substrate 28. The radiating elements of the circuit board 26 are formed by four square flat patches $\mathbf{30}_1$, $\mathbf{30}_2$, $\mathbf{30}_3$, $\mathbf{30}_4$, etched in the upper face of substrate 320 of the circuit board 16, each patch $\mathbf{30}_1$ to $\mathbf{30}_4$ being arranged respectively opposite the corresponding patch $\mathbf{29}_1$ to $\mathbf{29}_4$. The lower surface $\mathbf{320}_1$ of the substrate 320 turned towards the cavity $\mathbf{24}_2$ is metallized, forming an earth plane, and is in contact with the conducting walls of the shell 24 while the upper surface turned towards the cone 20 has the patches $\mathbf{30}_1$, $\mathbf{30}_2$, $\mathbf{30}_3$, $\mathbf{30}_4$ and the excitation circuit 31.

FIG. 3.*a* shows the various elements forming the reception circuit board 16. This circuit board has a circular aperture whose centre is coincident with that of the circuit board 16 through which the shell 24 passes and round which the four patches $\mathbf{30}_1$, $\mathbf{30}_2$, $\mathbf{30}_3$, $\mathbf{30}_4$ are arranged. The circuit board 16 also has the excitation circuit 31 comprising lines 32 designed to carry vertically polarized waves and lines 33 designed to conduct horizontally polarized waves.

Four quadrants $\mathbf{34}_1$, $\mathbf{34}_2$, $\mathbf{34}_3$, $\mathbf{34}_4$ can be defined, these being bounded by the horizontal $\mathbf{35}_1$ and vertical $\mathbf{35}_2$ mid-lines of the circuit board 16 passing respectively through the middle of the vertical and horizontal edges of the circuit board 16. These quadrants $\mathbf{34}_1$, $\mathbf{34}_2$, $\mathbf{34}_3$, $\mathbf{34}_4$ have respectively the patches $\mathbf{30}_1$, $\mathbf{30}_2$, $\mathbf{30}_3$, $\mathbf{30}_4$, each patch being arranged symmetrically with the patch contained in the bordering quadrant with respect to the horizontal $\mathbf{35}_1$ and vertical $\mathbf{35}_2$ mid-lines.

Each patch $\mathbf{30}_1$, $\mathbf{30}_2$ has, respectively, a point of connection $A_1$, $A_2$ between the upper edge of the said patch $\mathbf{30}_1$, $\mathbf{30}_2$ and respectively a vertical excitation line $L_1$, $L_2$ designed to guide vertically polarized waves. These two lines $L_1$, $L_2$ both bend at right angles and join together an intersection point $C_1$ situated on the vertical mid-line $\mathbf{35}_2$. Similarly, each patch $\mathbf{30}_3$ and $\mathbf{30}_4$ has, respectively, a connection point $A_3$, $A_4$ between the lower edge of the said patch $\mathbf{30}_3$, $\mathbf{30}_4$ with respectively a vertical excitation line $L_3$, $L_4$ designed to guide vertically polarized waves. These two lines $L_3$, $L_4$ are both bent at right angles and join together at a connection point $C_2$ situated on the vertical mid-line $\mathbf{35}_2$. Starting respectively, from these points $C_1$ and $C_2$ are two vertical lines which form a first right-angle bend, changing the said lines into two horizontal lines etched respectively into the quadrants $\mathbf{34}_2$ and $\mathbf{34}_4$ and which then form a second right-angle bend, changing them into two vertical lines which meet at a point $C_3$ located at a distance $\Delta L$ from the horizontal mid-line $\mathbf{35}_1$. A principal line for the excitation of vertically polarized waves starts at the point $C_3$ and ends at the connection point $C_4$.

Furthermore, patches $\mathbf{30}_1$, $\mathbf{30}_3$ have respectively a connection point $B_1$, $B_3$ between both the right edge of the patches $\mathbf{30}_1$, $\mathbf{30}_3$ respectively and the horizontal excitation line $L_5$, $L_6$ respectively designed to guide horizontally polarized waves. Similarly, the patches $\mathbf{30}_2$, $\mathbf{30}_4$ have respectively an intersection point $B_2$, $B_4$ between the left edge of the said patches $\mathbf{30}_2$, $\mathbf{30}_4$ and a horizontal excitation line $L_7$, $L_8$ designed to guide horizontally polarized waves. The lines $L_5$ and $L_7$ meet at a point $C_5$ contained in the quadrant $\mathbf{34}_1$ and at a distance ΔL from the mid-line $\mathbf{35}_2$ while the lines $L_6$ and $L_8$ meet at a point $C_6$ contained in the quadrant $\mathbf{34}_3$ and also separated by distance ΔL from the mid-line $\mathbf{35}_2$, so that the said points $C_5$ and $C_6$ are symmetrical with respect to the mid-line $\mathbf{35}_1$. From these points $C_5$ and $C_6$ start two lines which meet at a point $C_7$ located on the mid-line $\mathbf{35}_1$ from which starts a principal excitation line which is designed to guide horizontally polarized waves and ends at a connection point $C_8$.

It is worth noting that the various bends present in the excitation lines designed to guide horizontally and vertically polarized waves do not have to be at right angles.

In the present embodiment, the upper face 21 is square with sides of length 10 cm and the body has a height of approximately 8 cm. The shell 24 has an internal diameter of 3.25 cm and an external diameter of 3.66 cm.

The patches $\mathbf{29}_1$, $\mathbf{29}_2$, $\mathbf{29}_3$, $\mathbf{29}_4$, $\mathbf{30}_1$, $\mathbf{30}_2$, $\mathbf{30}_3$, $\mathbf{30}_4$, have respectively one side approximately equal to $\lambda_{GR}/2$, $\lambda_{GR}$ being the wavelength of the guided wave received. Furthermore, it is possible to use a substrate based on ceramic-filled Teflon.

FIG. 3.*b* shows the various components of the auxiliary circuit board 17. This circuit board has four patches $\mathbf{29}_1$, $\mathbf{29}_2$, $\mathbf{29}_3$, $\mathbf{29}_4$ and a circular aperture centred on the centre of the circuit board 17 through which the shell 24 passes.

FIG. 3.*c* shows an enlarged view of the region D of FIG. 2, revealing a detailed picture of the various components of the two circuit boards 16 and 17. The thickness Δ of foam may, in the present embodiment, be around 0.06 to 0.08 times the wavelength $\lambda_{GR}$ of the received wave, i.e. around 4 mm to 7 mm.

In FIG. 4, the device according to the present embodiment has an intermediate circuit board 37 on which the reception circuit (not shown) comprising at least one low-noise amplifier and a frequency converter are laid out. Coaxial cables (for reasons of clarity, only one coaxial cable 38 has been drawn) connect the connection points $C_4$ and $C_8$ to the reception circuit of the circuit board 37 with a view to processing the signals received. The output of the reception circuit is connected, through an aperture 39 made in the body 18, to the coaxial cable 8.

According to a variant (not shown), a single oscillator can be used for the conversion to high frequencies of the signals that are to be transmitted and for the conversion to low frequencies of the signals that are to be received. More generally, several identical components may be used for the conversion of received and transmitted signals. The circuit board 37 can act as a support for these different components. Within this framework, at least one coaxial cable is laid out between the circuit board 37 and the transmission circuit board 27.

FIG. 5 shows an important variation of the embodiment of FIG. 2. When the wave in the high-frequency band is circularly polarized (right or left), the rod 19 is advantageously replaced with a coaxial line 42, one end of which is connected to the transmission circuits and the other end of which is connected to a helix 40 made up of a series of turns 41, this helical antenna operating in axial mode. The circular cross section of the helix is then reduced to one-third of the wavelength. As shown on FIG. 5, the diameter of the shell 24 undergoes a discontinuity at the link between the coaxial line and the helix. The operation of such a helical device is described in "Les techniques de l'ingénieur" E3283—12–13, version 3-1991, and in the book "Antenna Engineering Handbook". Second edition, Richard C. Johnson and Henry Jasik, Chapter 13: "Helical antennas".

The device according to the invention operates as follows:

Electromagnetic waves arriving at the reflector 5 are reflected and focused onto the reflector focus which is located near the geometric centre of the array of the circuit board 17. The array of the circuit board 16 operates at a central resonant frequency $F_0$ while the array of the circuit board 17 operates as a resonant frequency $F_0'$ which is slightly offset with respect to the said frequency $F_0$, so that the combination of the two circuit boards 16 and 17 acts as a single array with an extended bandwidth.

Moreover, the patches $\mathbf{30}_1$, $\mathbf{30}_2$, $\mathbf{30}_3$, $\mathbf{30}_4$ are all fed in phase and with the same amplitude by two microstrip power dividers, the patch feed having to be in phase so that the electric fields are additive in the propagation direction of the guided waves. This is because, the phase shift d between two horizontally polarized waves, for example, is given by: $d=\beta\Delta L$, or $\beta=2\pi/\lambda_g$, $\lambda_g$ being equal to the wavelength of the guided wave.

In the preferred embodiment of the invention, $B_1$, $B_2$ and $B_3$, $B_4$ are excited by opposite sides of the patches, respectively. Thus the patch $\mathbf{30}_1$, is excited by its right side, which creates, at time t, a field E oriented from right to left, while, simultaneously, the patch $\mathbf{30}_2$ is excited by its left side, which creates, at the same time t, a field E oriented from left to right, which finally creates fields which are out of phase by π. By introducing a path difference of $\Delta L=\lambda_g/2$, an additional phase difference d is created such that: $d=\beta\Delta L=(2\pi/\lambda_g)(\lambda_g/2)=\pi$, thereby cancelling out the phase difference between the said electric fields. This configuration improves the quality of the polarization since it eliminates the problems of cross polarization. Furthermore, because of the symmetries existing between the patches which are side by side, the reflections of the waves are cancelled out.

Of course, where the patches $\mathbf{30}_1$, $\mathbf{30}_2$, $\mathbf{30}_3$, $\mathbf{30}_4$ are excited from the same side, the path difference becomes equal to $\lambda_g$, so that the phase difference also comes to 2π.

The said waves, received and carried by the lines 32 and 33, are delivered, via the cable 38, to the reception circuit of the circuit board 37, for example, which, after conversion of the received signals into intermediate frequencies, transmits these signals to the interior unit 9 via the cable 8.

Simultaneously, the signals coming from the said unit 9 pass through the frequency conversion circuit, laid out on the circuit board 27 for example, and supply the probes $\mathbf{280}_1$, $\mathbf{280}_2$ with waves to be transmitted to the rod 19 which transmits the maximum power along the axis D of the rod 19.

Due to the shape of the dielectric transmitting antenna, which occupies the minimum possible space, reception is not disturbed. Indeed, the cylindro-conical shape of the guide (19, 24) upstream of the first circuit board (16) in the wave reception direction means that the radiation pattern of the said array of radiating elements $(\mathbf{30}_1, \mathbf{30}_2, \mathbf{30}_3, \mathbf{30}_4)$ is not disturbed.

Thus, the device according to the invention means that a single device can operate simultaneously and in a completely decoupled manner, as a reception channel and a transmission channel.

The guide (19, 24) and the array of radiating elements $(\mathbf{30}_1, \mathbf{30}_2, \mathbf{30}_3, \mathbf{30}_4)$ are laid out so that their respective phase centres are nearly coincident at a single point forming the phase centre of the said device, allowing the said device to operate, in reception and in transmission, as a primary source pointing in a given direction, this primary source being located at the focus of the focusing means of a reception/transmission system according to the invention, such as a parabola or an electromagnetic lens.

According to one variant of the invention (not shown), at least one of the phase centres can be defocused so as to transmit in a direction other than the reception direction.

The devices according to the invention can also be implemented in the clusters of satellites in circular orbits, particularly in low orbit (Low Earth Orbit or LEO) or in mid orbit (Mid Earth Orbit or MEO).

As previously emphasized, the device according to the invention enables a ratio between the central frequencies of the transmission and reception bands respectively of less than or equal to three to be obtained, with a small number of patches such as 4, in order to minimize the complexity of the device.

In contrast, the device of the prior art cited in the preamble of the present application does not allow reception and transmission in the frequency bands Fb and Fh respectively for reception and transmission to be close enough if any four radiating elements are considered. So, if d1 is the distance separating two radiating elements which are symmetrically opposed with respect to the phase centre, and d2 is the diameter of the horn, and Lb and Lh are the wavelengths corresponding to the frequencies Fb and Fh respectively, in order to obtain the equivalent illumination at the two frequencies it is typically necessary to have:

d1=0.8×Lb (cf. "Microstrip feeds for prime focus fed reflector antennas", IEE Proceedings, Vol. 134, PT.H, No. 2, April 1987, p. 190), d2=1.5×Lh (cf. "Antenna Engineering Book" Second edition, Richard C. Johnson, McGraw-Hill Book Company, Chapter 15).

Furthermore, for reasons of physical size, it is typically necessary to have D=0.6×d, which means that:

Fh/Fb=Lb/Lh=1.5/0.48=3.125.

Of course, the invention is not limited to the embodiments described. The guide selected could be rectangular if one polarization is to be favoured over the other. In addition, the patches $\mathbf{29}_1$, $\mathbf{29}_2$, $\mathbf{29}_3$, $\mathbf{29}_4$, $\mathbf{30}_1$, $\mathbf{30}_2$, $\mathbf{30}_3$, $\mathbf{30}_4$ can be circular or rectangular. It is also possible to imagine other shapes of radiating elements and other configurations of the said elements, such as that where the four flat patches $\mathbf{29}_1$, $\mathbf{29}_2$, $\mathbf{29}_3$, $\mathbf{29}_4$ are etched in that upper face $\mathbf{28}_2$ of the circuit board 17 which is turned towards space where the waves are radiated.

Similarly, the path difference ΔL can be zero. Although only one configuration has been described for the structure of the microstrip lines of the circuit board 16, it is obvious that other configurations could be envisaged.

It is to be emphasized that the reception and transmission circuits of the device according to the invention can also be arranged on one and the same circuit board having the double function of supporting the reception circuit and the transmission circuit. In this case the said circuits are laid out in such a way as to avoid any electromagnetic coupling between the reception circuit and the transmission circuit. Moreover, the junctions between the excitation lines of the reception circuit and those of transmission circuit would be provided, for example, by bridges.

What is claimed is:

1. Device for reception/transmission of electromagnetic waves, comprising:

a reception circuit board including a first array of n radiating elements with a microstrip structure for the reception of electromagnetic waves in a first frequency band;

an electromagnetic traveling wave antenna with longitudinal radiation defining a radiation axis for the transmission of electromagnetic waves in a second frequency band; and excitation means for exciting said traveling wave antenna, said radiating element and traveling wave antenna having a phase center and a radiation axis which are substantially common.

2. Device according to claim 1, wherein said traveling wave antenna comprises a dielectric rod with longitudinal radiation whose axis is coincident with a transmission radiation axis.

3. Device according to claim 2, wherein said excitation means comprises a waveguide.

4. Device according to claim 2, wherein said dielectric rod has the shape of a cylinder with conical ends.

5. Device according to claim 4, wherein said waveguide is closed by a quarter-wave ($\lambda_{GT}/4$) cavity of length equal to a quarter of the wavelength ($\lambda_{GT}$) of the guided wave transmitted.

6. Device according to claim 1, wherein said traveling wave antenna comprises a helical device having a series of turns.

7. Device according to claim 6, wherein said excitation means comprises a coaxial line.

8. Device according to claim 1, wherein n is equal to 4.

9. Device according to claim 1, wherein said excitation means are coupled to a microstrip transmission circuit board laid out in a straight section of said excitation means for transmission of electromagnetic waves.

10. Device according to claim 9, further comprising a pair of probes arranged on said transmission circuit board and at right angels to each other and capable of transmitting orthogonally polarized waves.

11. Device according to claim 9, wherein said microstrip transmission circuit board has a frequency conversion circuit.

12. Device according to claim 11, wherein said microstrip transmission circuit board comprises an intermediate circuit board having at least part of said frequency conversion circuit associated with said reception circuit board and/or said transmission circuit board.

13. Device according to claim 1, wherein said reception circuit board has a frequency conversion circuit.

14. Device according to claim 1, wherein an auxiliary circuit board is associated, in a parallel manner, with said reception circuit board and has a second array comprising a plurality of radiating elements opposite said respective plurality of radiating elements of said first array and of resonant frequency ($F_0$) close to said resonant frequency ($F_0$) of said first array so that the pair of arrays of radiating elements opposite each other is equivalent to a single array with an extended bandwidth.

* * * * *